US007784631B2

(12) United States Patent
Winn et al.

(10) Patent No.: US 7,784,631 B2
(45) Date of Patent: Aug. 31, 2010

(54) PANEL/GATE INTERCONNECTION MEANS FOR A COLLAPSIBLE MATERIALS HANDLING CONTAINER

(75) Inventors: Arthur Raymond Winn, Golden Grove (AU); Trevor Dean Kelly, Shiedow Park (AU)

(73) Assignee: Rees Operations Pty Ltd, Camden Park (AU)

( * ) Notice: Subject to any disclaimer, the term of this patent is extended or adjusted under 35 U.S.C. 154(b) by 1176 days.

(21) Appl. No.: 10/523,896

(22) PCT Filed: Aug. 8, 2002

(86) PCT No.: PCT/AU02/01048

§ 371 (c)(1),
(2), (4) Date: Nov. 2, 2005

(87) PCT Pub. No.: WO2004/014748

PCT Pub. Date: Feb. 19, 2004

(65) Prior Publication Data

US 2006/0144838 A1 Jul. 6, 2006

(51) Int. Cl.
*B65D 8/14* (2006.01)

(52) U.S. Cl. ..... 220/6; 220/1.5; 220/4.28; 220/4.29; 220/7; 220/9.2; 220/579; 220/610; 220/666; 220/682; 220/692

(58) Field of Classification Search ..... 220/6, 220/4.28, 4.29, 610, 684, 666, 692, 682, 220/579, 9.2, 1.5, 7
See application file for complete search history.

(56) References Cited

U.S. PATENT DOCUMENTS

| | | | | |
|---|---|---|---|---|
| 1,129,040 | A * | 2/1915 | McClure | 138/156 |
| 3,401,814 | A * | 9/1968 | Chiswell et al. | 220/4.33 |
| 3,981,410 | A * | 9/1976 | Schurch | 220/6 |
| 4,020,967 | A * | 5/1977 | Hammond et al. | 220/6 |
| 4,591,065 | A * | 5/1986 | Foy | 220/7 |
| 5,161,709 | A * | 11/1992 | Oestreich, Jr. | 220/6 |
| 5,261,550 | A * | 11/1993 | Karpisek | 220/4.33 |
| 5,711,444 | A * | 1/1998 | Meacham et al. | 220/6 |
| 5,862,931 | A * | 1/1999 | Cox et al. | 220/6 |
| 6,299,009 | B1 * | 10/2001 | Ryziuk et al. | 220/1.5 |
| 6,691,885 | B2 * | 2/2004 | Brown | 220/7 |

FOREIGN PATENT DOCUMENTS

DE 3633348 A1 * 4/1988

* cited by examiner

*Primary Examiner*—Anthony Stashick
*Assistant Examiner*—Elizabeth Volz
(74) *Attorney, Agent, or Firm*—Gordon & Rees LLP

(57) ABSTRACT

The invention provides improved collapsible storage container (10) which has a first pair of folding side gates (11) and a second pair of folding end gates (12), with each gate (11, 12) being pivotally mounted with respect to a pallet base. Each gate (11) has detachably mounted along opposite vertical margins thereof approximately c-shaped posts (22) each of which has a locking flange (23). Each gate (12) has angle members (35) attached to and extending along opposite vertical frame members (30, 31) and forming therewith a flange receiving slot (40) for slidably locating a respective locking flange (23). The gates (11, 12) when in their erect positions interlock with one another along their adjacent vertical margins which enhances the stiffness and rigidity of the container (10).

8 Claims, 5 Drawing Sheets

PANEL/GATE INTERCONNECTION MEANS FOR A COLLAPSIBLE MATERIALS HANDLING CONTAINER

This invention relates to an improved collapsible container for materials handling purposes of the kind which includes a generally rectangular base, and four pivotally mounted gates or panels which, can be pivoted between erect in-use positions, wherein they extend vertically upwards from respective side edge portions of the base of the container, and collapsed positions wherein they overlie one another on top of the base.

Collapsible containers having side and end panels/gates which are pivotally attached to the container base for folding movement between upright erected positions and collapsed positions wherein they lie in a flat condition on top of the base, are well known in the materials handling industry. Many different types of pivotal connections between the panels/gates and the base have been utilised, including both permanent attachments therebetween, as well as detachable connections which allow the panels/gates to be physically separated from the base if required. When the panels/gates are erect, generally the opposite vertical perimeter frame members on one panel respectively abut against inner faces of adjacent panels, with adjacent panels being interlocked by means of manually releasable locking or latching mechanisms which are normally located at the top corners of the panels and which, when in their locking conditions, securely lock the adjacent panels together in their upright positions.

The materials handling industry is extremely competitive and one of the prime design factors for manufacturers of collapsible containers is the fabrication costs and the need to reduce the cost of manufacture wherever possible. One of the drawbacks of current container designs is their inflexibility and in particular the inability to be able to readily interchange one gate for another type of gate or replace an existing infill panel with a different one, eg a solid one-piece infill panel for a metal mesh infill panel.

It would be advantageous, from the point of view of cost of manufacture, for the side and end gates to have a modular construction so that a manufacturer's inventory of components for collapsible containers having different configurations, can be reduced.

It is an object of the present invention to provide improvements to a collapsible container for the storage of goods/materials wherein the gates of the container are of modular design and can be interchanged in whole or in part, with other gates.

It is another object of the present invention to provide gates for a collapsible materials handling container which are constructed in a manner which allows their infill panel to be readily changed for another infix panel.

It is a still further object of the present invention to provide an improved collapsible container having gates which, when erect, interlock with one another and provide enhanced stiffness and rigidity to the container.

SUMMARY OF THE INVENTION

According to a first aspect of the invention therefore, there is provided a collapsible storage container comprising a base, two pairs of opposite side and end gates each pivotally mounted with respect to the base for folding movement between an erect in-use position and a collapsed position on top of the base, each said gate having a rectangular or square infill panel having an inner face and an outer face, an outer perimeter frame secured to the outer face of the infill panel, characterised by:

first elongate perimeter frame attachment members attached to and extending along opposite vertical margins of each of the side gates and each having a laterally inwards directed locking flange which lies in a plane parallel to the plane of the inner face of its associated said infill panel and spaced inwardly therefrom, second elongate perimeter frame attachment members attached to and extending along opposite vertical margins of each of the end gates and defining therewith an outwardly opening locking flange receiving slot, said first and second frame attachment members being interlockable such that, when the container is in an erect in-use condition, said locking flanges locate in respective said flange receiving slots, and locking means arranged to releasably lock the first and second frame attachment members against relative movement when interlocked and to thereby lock adjacent side and end gates together in their erect in-use position.

Preferably, each said second frame attachment member is an angle frame member having one flange contiguous with the inner face of its associated said infill panel, and its other flange projecting outwardly and lying parallel with the vertical end face of the gate or panel and spaced therefrom so as to form a respective said flange receiving slot extending the entire length of the vertical edge of the gate.

Preferably, each said first frame attachment member is an approximate C-section post which terminates at one end in a laterally inwards directed planar locking flange which lies parallel to the plane of the inner face of its associated said panel and spaced inwardly therefrom, the free edge of the locking flange being spaced laterally outwards from the vertical margin of the outer frame, and at its other end in an inwardly directed attachment flange which is attachable to the vertical margin of the outer frame.

Desirably, the C-section posts extend along both vertical side margins of the outer frame and are detachably secured thereto.

Preferably the C-section posts are detachably secured by means of spring loaded latch bolts which slide between an extended locking position wherein each bolt passes through an aperture formed in the attachment flange of the post, and a retracted unlocked position wherein the bolt is disengaged from the aperture, whereupon the C-section post can be detached from its gate.

Desirably, in order to securely interlock adjacent panels together when in their erect in-use positions, there is provided a spring loaded slidable latching bolt mounted adjacent each of the upper corner regions of the end gates and which is arranged to pass through aligned holes or openings formed in the locking flange of the C-section post and the outwardly projecting flange of the angle frame member.

According to another aspect of this invention, there is provided an improved collapsible storage container of the type comprising a base, two pairs of opposite side and end gates each pivotally mounted with respect to the base for folding movement between an erect in-use position and a collapsed position on top of the base, characterised in that adjacent vertical margins of adjacent said gates when in their erect in-use positions, have flange formations which interlock with one another, said interlocking flange formations being locked against relative movement by means of a sliding locking bolt mounted on one of said gates and which passes through aligned holes formed in said flange formations.

According to yet another aspect of the present invention, there is provided an improved gate assembly for a collapsible container including:

a replaceable central infill panel which is either square or rectangular, outer frame members extending around the perimeter of the infill panel on the outer face thereof, and a pair of angle section frame members located on the inner corners of said infill panel and each having one of its flanges abutting the inner face of the infill panel and its other flange extending along a vertical edge of the gate, said infill panel being clampingly secured between said angle frame members and the outer frame members by means of screws or other suitable removable fasteners.

With this arrangement, if the infill panel needs to be changed with another infill panel of a different type, eg a mesh panel instead of a solid plastics panel, this can be done quite readily without the need to fabricate an entirely new gate assembly.

The invention will now be described by way of example with reference to the accompanying drawings in which:

FIG. 8 is a fragmentary perspective view of the other gate shown in FIG. 2; while

Figure 1:
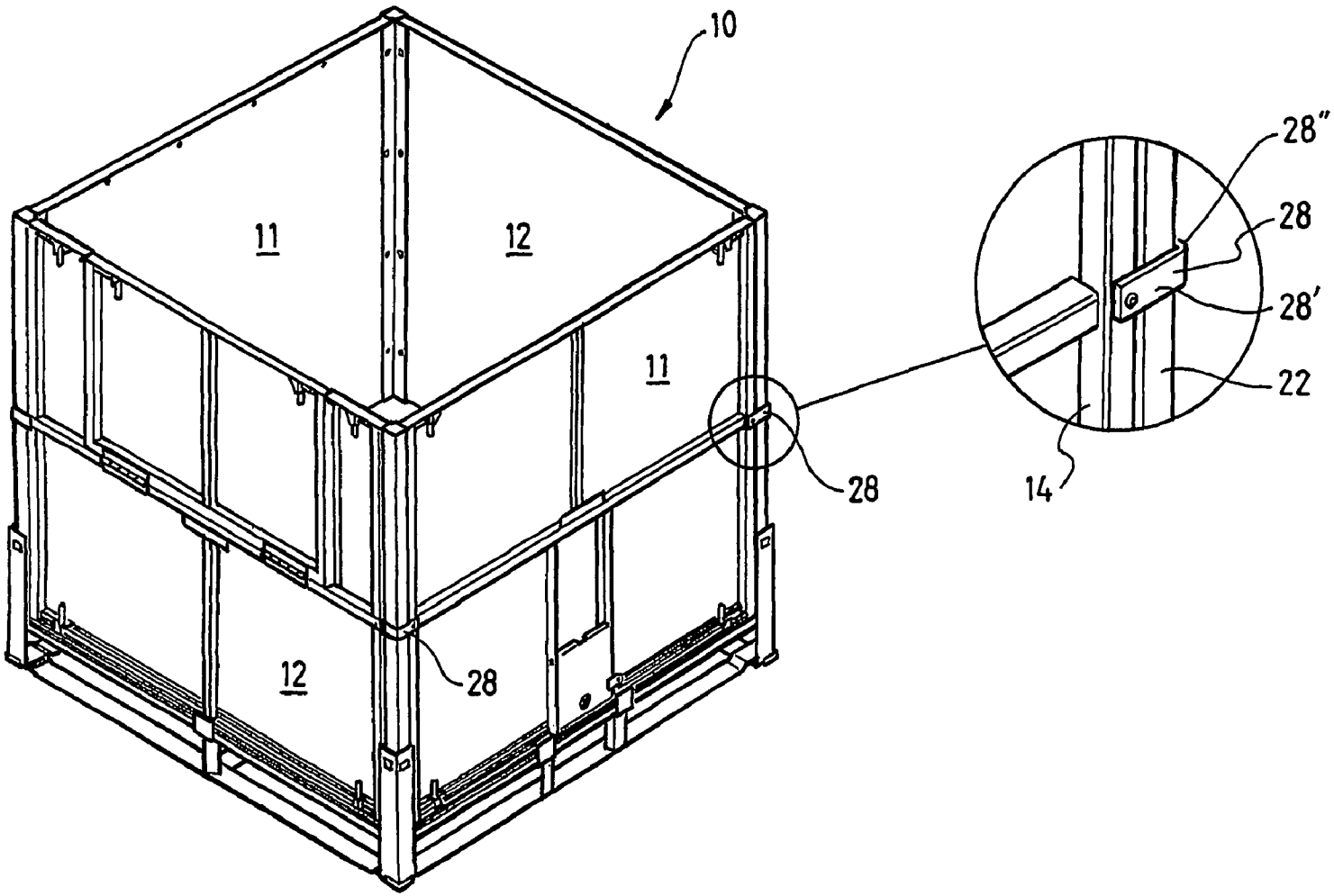
FIG. 1 is a perspective view of an erect container (without lid) made in accordance with this invention.
Figure 2:
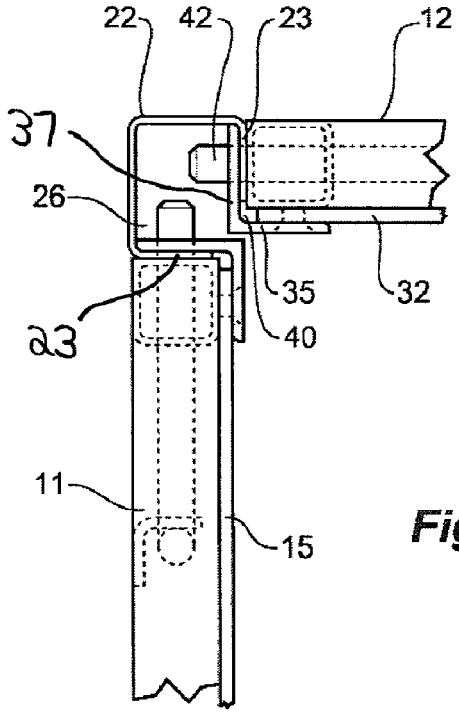
FIG. 2 is a fragmentary plan view of a pair of adjacent gates of the collapsible storage container shown in FIG. 1, when in their interlocked erect in-use positions.

Referring to FIG. 1, there is shown a collapsible storage container 10 of the kind which includes a rectangular pallet base which is provided at each of its four corners with stub corner posts of angle section, the base having a horizontal removable floor panel supported by a plurality of upper deck metal members also of angle section. Additional intermediate bearers are also provided to support the floor.

In this embodiment, the container 10 is provided with a first pair of folding side gates 11 and a second pair of opposite folding end gates 12, each panel 11, 12 being pivotally mounted adjacent its bottom corners to respective corner posts to allow the panel to swing inwardly from its erect in-use position to a collapsed position on top of the pallet base. The panels 11, 12 when in their erect positions interlock with one another along their adjacent vertical margins which enhances the stiffness and rigidity of the container when erected.

Figure 3:
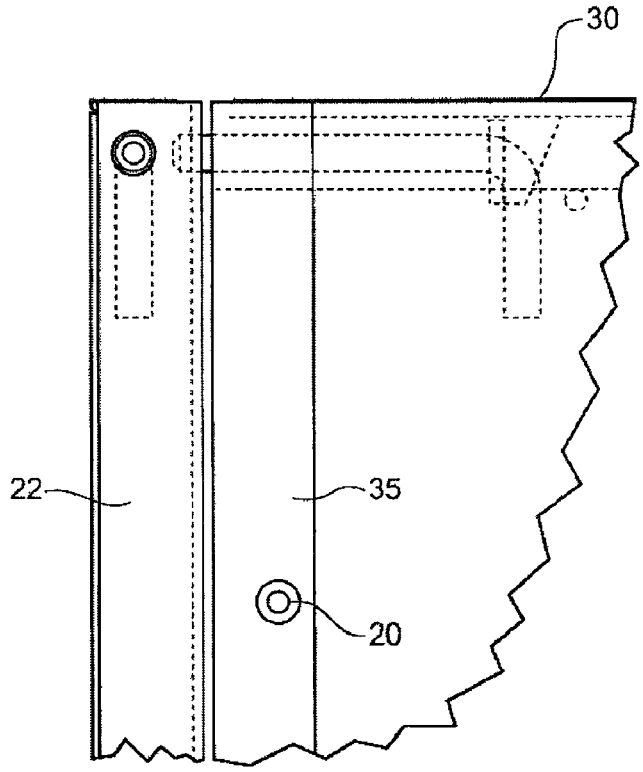
FIG. 3 is a fragmentary side elevational view of the erect panels shown in FIG. 2.
Figure 4:
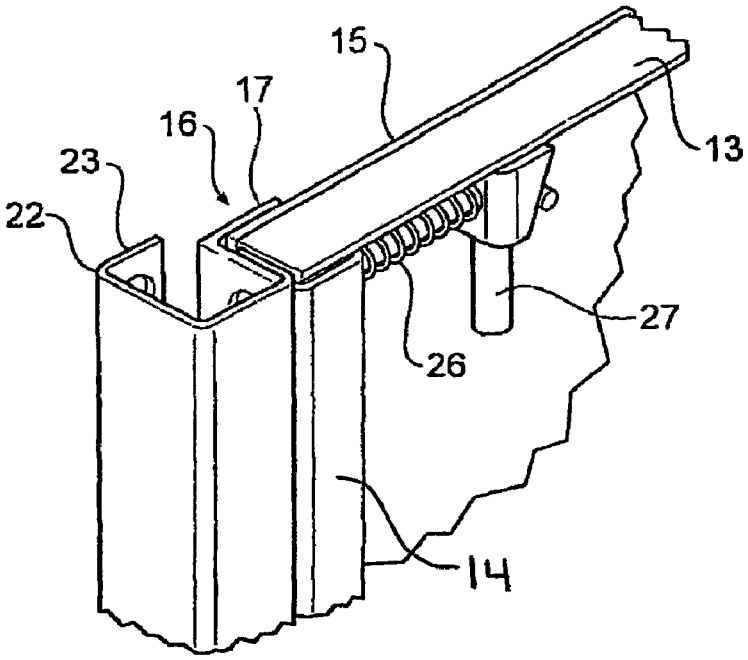
FIG. 4 is a fragmentary perspective view of one of the panels shown in FIG. 2.
Figure 5:
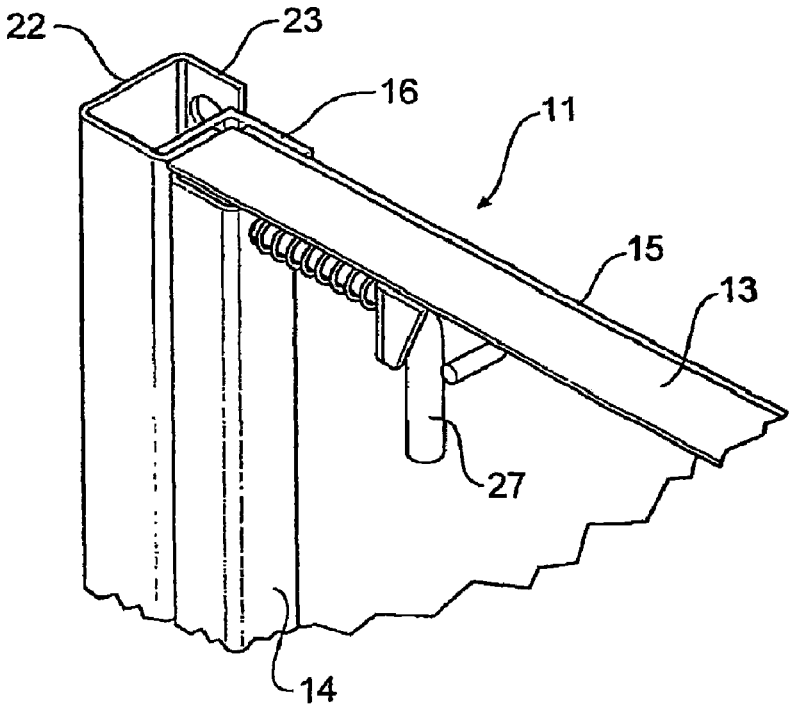
FIG. 5 is another fragmentary perspective view of the panel shown in FIG. 4.
Figure 6:
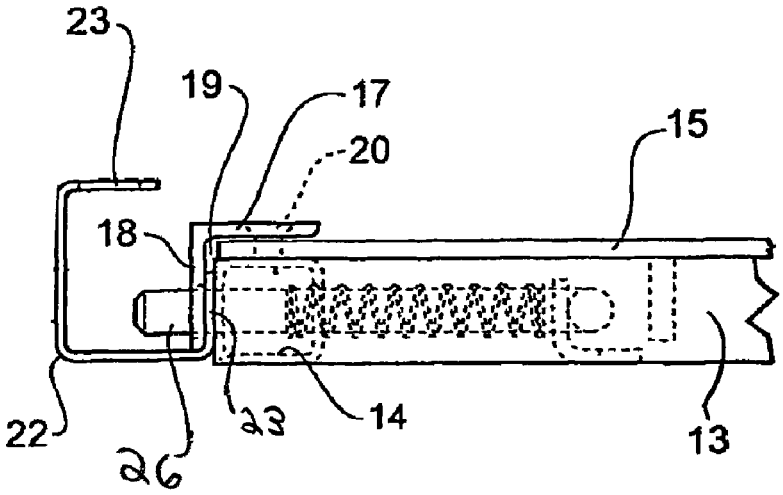
FIG. 6 is a fragmentary plan view of the gate shown in FIG. 4.

As shown in FIG. 3, folding gate 11 comprises an outer peripheral metal frame of tubular or angle section frame members 13, 14 to which are secured a solid plastic infill panel 15 located on the inside of the frame members 13, 14. The panel 15 is damped to the outer metal frame by means of a pair of opposite angle section damping members 16 each of which has one of its flanges 17 abutting against the inner face of the panel 15, and its other flange 18 extending outwardly and spaced a short distance from the vertical end face of frame member 14 so as to form a flange receiving slot or recess 19. Screws 20 are used to fasten the angle section clamping members 16 and in turn the infill panel 15 to the outer metal frame members 13, 14.

Each gate 11 has detachably mounted along opposite sides thereof approximate C-section posts 22 each of which has a laterally inwards directed locking flange 23 which is spaced forwardly of the inner face of the infill panel 15, and an inwardly directed attachment return flange 25 which locates in the slot or recess 19. Each post 22 is attached to the clamping member 16 by means of a plurality of retractable spring loaded locking bolts 26 which are mounted in the top and bottom corner regions of the outer metal frame formed by the frame members 13, 14. The locking bolts 26 are manually actuated by handles 27 and desirably must be partly rotated before being able to slide axially between their retracted and extended positions. When extended, the bolt 26 passes through aligned holes formed in the flanges 18, 25 and also the walls of the vertical frame member 14. In addition to the bolts 26, each post 22 is also attached to its perimeter frame member 14 by means of an angle bracket 28 which has one of its legs 28' fastened to the frame member 14 and its other leg 28" hooked around the post 22 and which serves as an anti-burst abutment for the gate 12 when folded outwardly to its erect position.

Figure 7:
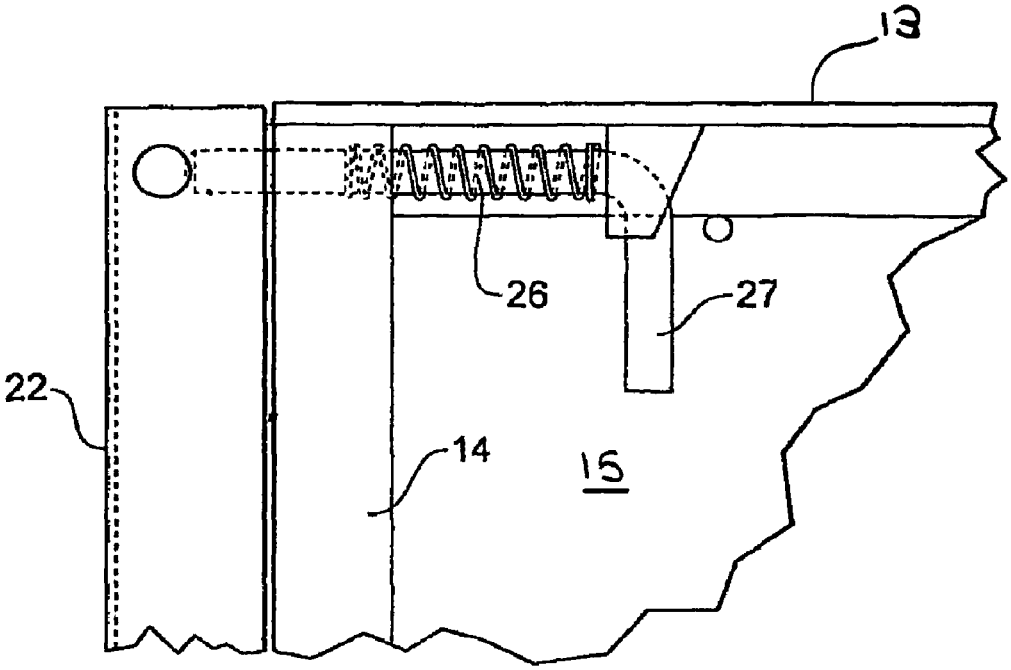
FIG. 7 is a fragmentary side elevational view of the gate of FIG. 4.
Figure 9:
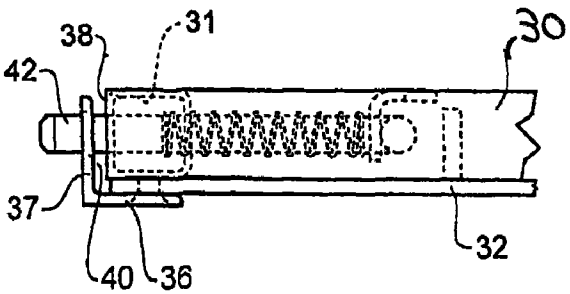
FIGS. 9 and 10 are fragmentary plan and side elevational views of the other gate shown in FIG. 8.
Figure 10:
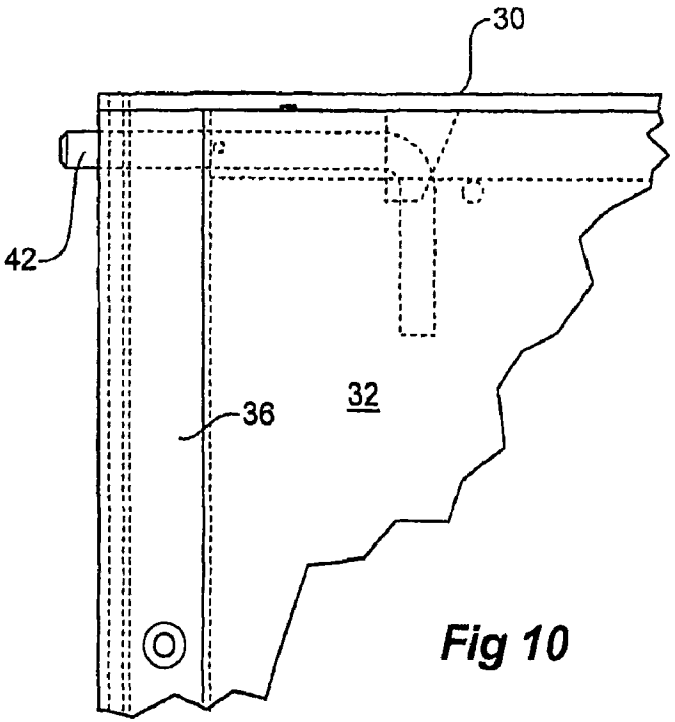
Figure 8:
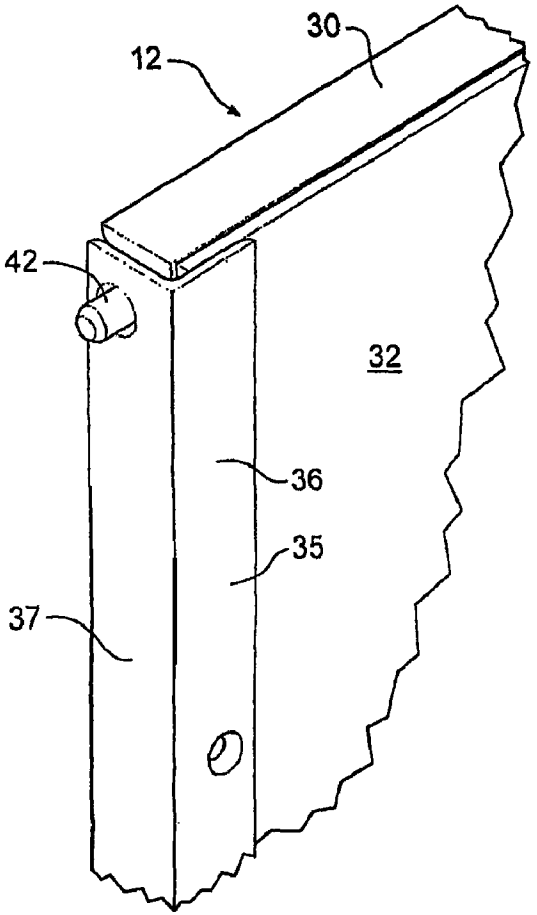

Referring to FIGS. 7 to 9 of the accompanying drawings, the folding gate 12 similarly comprises an outer perimeter metal frame of tubular or angle section frame members 30, 31 to which are secured a solid plastic infill panel 32 located on the inside of the frame members 30, 31. As with the gate 11, the panel 32 is clamped against the inside of the frame members 30, 31 by means of angle clamping members 35 and fastening screws (not shown) which pass through aligned holes formed in flange 36, panel 32 and frame member 31. Flange 37 of angle member 35 is spaced laterally outwards from the vertical end wall 38 of frame member 31 so as to form a flange receiving slot or recess 40 for slidably locating locking flange 23 of C-section post 22 on the panel 11, when the panels 11, 12 are in their erect in-use positions. The interlocking relationship between the interlock members 22, 35 is dearly shown in FIG. 1 of the drawings.

Retractable latch bolts 42 are slidably mounted in each corner region of the gate 12 and can be conveniently retracted to permit the locking flange 23 to engage in the slot 40 as the panel 12 is swung upwardly to its upright position. The latch bolt 42 is arranged to pass through aligned holes formed in a wall of the frame member 31, locking flange 23 and flange 37 of interlock member 35.

It will be appreciated that the modular design construction of the gates 11, 12 provides increased design flexibility. The same gate module can be used for both the side and end gates of the container. For the side gates, only the C-section attachment members 22 need to be fitted to the module on opposite vertical sides thereof. Also gates can be readily interchanged, eg by for example so as to convert a one-piece end gate into a bi-fold gate which is divided horizontally into two halves hinged together to permit the two halves to hinge relative to one another, or modified so as to include a hopper in its top or bottom half. In addition the infill panels of the gates can be readily changed, for example from a one-piece solid plastics panel to a metal mesh infill panel. This can be achieved by unscrewing the fasteners which secure the angle section damping members to the outer frame, removing the existing infill panel and replacing it with a new one, and thereafter reattaching the angle clamping members with the fastening screws to the outer perimeter metal frame.

It will be appreciated by persons skilled in the art that numerous variations and/or modifications may be made to the invention as shown in the specific embodiment without departing from the spirit or scope of the invention as broadly described. The above-described embodiment is therefore to be considered in all respects as illustrative and not restrictive.

The claims defining the invention are as follows:

1. A collapsible storage container, comprising:

a base;

two pairs of opposite side and end gates each pivotally mounted with respect to the base for folding movement between an erect in-use position and a collapsed position on top of the base, each said gate having a rectangular infill panel having an inner face and an outer face, and an outer perimeter frame secured to the outer face of the infill panel, four hollow corner post members, each corner post member terminating at its ends in a pair of laterally inwardly directed locking flanges, the laterally inwardly directed locking flanges being perpendicular to one another, frame attachment members attached to and extending along opposite vertical margins of each of the end gates and defining therewith an outwardly opening locking flange receiving slot dimensioned to receive one of the laterally inwardly directed locking flanges therein such that the corner post members and frame attachment members interlock with one another when the container is in its erect in-use position, locking means to releasably lock the frame attachment members to the corner posts when in their interlocking erect in-use position, thereby locking each pair of adjacent side and end gates together in their erect in-use positions, wherein each corner post member terminates at one of its ends in said laterally inwards directed locking flange, the free edge of said locking flange being spaced laterally outwards from the vertical margin of the outer frame, and at its other end in an inturned inwardly directed attachment flange arranged to be attached to a respective said vertical margin of each of the outer frames;

and further comprising detachable securing means for detachably securing each said corner post member along a respective vertical margin of its associated said gate, wherein said detachable securing means comprises a plurality of locking bolts movable between an extending locking position wherein each locking bolt passes through an aperture formed in said locking flange of the corner post member and a retracted unlocked position, in which position the corner post member can be detached from its associated said gate.

2. A collapsible storage container, comprising:

a base;

two pairs of opposite side and end gates each pivotally mounted with respect to the base for folding movement between an erect in-use position and a collapsed position on top of the base, each said gate having a rectangular infill panel having an inner face and an outer face, and an outer perimeter frame secured to the outer face of the infill panel, four hollow corner post members, each corner post member terminating at its ends in a pair of laterally inwardly directed locking flanges, the laterally inwardly directed locking flanges being perpendicular to one another, frame attachment members attached to and extending along opposite vertical margins of each of the end gates and defining therewith an outwardly opening locking flange receiving slot dimensioned to receive one of the laterally inwardly directed locking flanges therein such that the corner post members and frame attachment members interlock with one another when the container is in its erect in-use position, and locking means to releasably lock the frame attachment members to the corner posts when in their interlocking erect in-use position, thereby locking each pair of adjacent side and end gates together in their erect in-use positions, wherein said locking means comprises a latching bolt mounted adjacent each of the upper corner regions of the end gates and which is arranged to pass through aligned holes or openings formed in the locking flange of the corner post member and a wall of the frame attachment member.

3. A collapsible storage container, comprising:

a base;

a pair of opposite side gates and a pair of opposite end gates, each said gate pivotally mounted with respect to the base for folding movement between an erect in-use position and a collapsed position on top of the base, each said gate having an infill panel having an inner face and an outer face, and an outer perimeter frame secured to the outer face of the infill panel so as to define at least vertical margins thereof;

said adjacent vertical margins of adjacent said gates when in their erect in-use positions, being interconnected by a corner post member detachably secured to and abutting each said vertical margin, each said corner post member having a hollow cross section that terminates at its ends in a pair of perpendicular inwardly directed locking flanges which respectively locate in outwardly opening flange receiving slots on the vertical margins of adjacent gates when the gates are in their erect in-use positions, the corner post members extending along the vertical margins of the gates, there being locking means for releasably locking each within its associated said flange receiving slot, wherein each of the gates has a two-flanged elongate angle frame member extending along each of its vertical margins with a first flange abutting the inner face of the infill panel and a second outwardly directed flange extending parallel to the vertical margin of the gate and spaced outwards therefrom so as to define said outwardly opening flange receiving slot extending along the entire length of the vertical edge of the gate, and wherein said locking means comprise slidable latch bolts mounted in upper and lower corners of each said gate, each said latch bolt, when in its latching position, respectively passing through aligned holes formed in the inwardly directly locking flanges of the corner post members, in the outwardly directed flange of the elongate angle frame members, and in the vertical margins of each said gate.

4. A collapsible storage container, comprising:

a base;

two pairs of opposite side and end gates each pivotally mounted with respect to the base for folding movement between an erect in-use position and a collapsed position on top of the base, each said gate having a rectangular infill panel having an inner face and an outer face, and an outer perimeter frame secured to the outer face of the infill panel, four hollow corner post members, each corner post member terminating at its ends in a pair of laterally inwardly directed locking flanges, the laterally inwardly directed locking flanges being perpendicular to one another, frame attachment members attached to and extending along opposite vertical margins of each of the end gates and defining therewith an outwardly opening locking flange receiving slot dimensioned to receive one of the laterally inwardly directed locking flanges therein such that the corner post members and frame attachment members interlock with one another when the container is in its erect in-use position, locking means to releasably lock the frame attachment members to the corner posts when in their interlocking erect in-use position, thereby locking each pair of adjacent side and end gates together in their erect in-use positions, wherein each corner post member terminates at one of its ends in said laterally inwards directed locking flange, the free edge of said locking flange being spaced laterally outwards from the vertical margin of the outer frame, and at its other end in an inturned inwardly directed attachment flange arranged to be attached to a respective said vertical margin of each of the outer frames, and a detachable securing means for detachably securing each said corner post member along a respective vertical margin of its associated said gate, wherein each said side gate is provided with an angle section frame member extending along each of its vertical margins, each angle section frame member having one of its flanges abutting the inner face of the infill panel, and its other flange extending rearwardly and lying parallel to a vertical margin of the outer perimeter frame, said other flange being spaced from said vertical margin so as to define an elongate slot for receiving a respective said attachment flange of a said corner post member, wherein said locking means comprises a latching bolt mounted adjacent each of the upper corner regions of the end gates and which is arranged to pass through aligned holes or openings formed in the locking flange of the corner post member and a wall of the frame attachment member.

5. A collapsible storage container, comprising:

a base;

two pairs of opposite side and end gates each pivotally mounted with respect to the base for folding movement between an erect in-use position and a collapsed position on top of the base, each said gate having a rectangular infill panel having an inner face and an outer face, and an outer perimeter frame secured to the outer face of the infill panel, four hollow corner post members, each corner post member terminating at its ends in a pair of laterally inwardly directed locking flanges, the laterally inwardly directed locking flanges being perpendicular to one another, frame attachment members attached to and extending along opposite vertical margins of each of the end gates and defining therewith an outwardly opening locking flange receiving slot dimensioned to receive one of the laterally inwardly directed locking flanges therein such that the corner post members and frame attachment members interlock with one another when the container is in its erect in-use position, and locking means to releasably lock the frame attachment members to the corner posts when in their interlocking erect in-use position, thereby locking each pair of adjacent side and end gates together in their erect in-use positions, wherein each corner post member terminates at one of its ends in said laterally inwards directed locking flange, the free edge of said locking flange being spaced laterally outwards from the vertical margin of the outer frame, and at its other end in an inturned inwardly directed attachment flange arranged to be attached to a respective said vertical margin of each of the outer frames, wherein said locking means comprises a latching bolt mounted adjacent each of the upper corner regions of the end gates and which is arranged to pass through aligned holes or openings formed in the locking flange of the corner post member and a wall of the frame attachment member.

6. A collapsible storage container, comprising:

a base;

two pairs of opposite side and end gates each pivotally mounted with respect to the base for folding movement between an erect in-use position and a collapsed position on top of the base, each said gate having a rectangular infill panel having an inner face and an outer face, and an outer perimeter frame secured to the outer face of the infill panel, four hollow corner post members, each corner post member terminating at its ends in a pair of laterally inwardly directed locking flanges, the laterally inwardly directed locking flanges being perpendicular to one another, frame attachment members attached to and extending along opposite vertical margins of each of the end gates and defining therewith an outwardly opening locking flange receiving slot dimensioned to receive one of the laterally inwardly directed locking flanges therein such that the corner post members and frame attachment members interlock with one another when the container is in its erect in-use position, and locking means to releasably lock the frame attachment members to the corner posts when in their interlocking erect in-use position, thereby locking each pair of adjacent side and end gates together in their erect in-use positions, wherein each corner post member terminates at one of its ends in said laterally inwards directed locking flange, the free edge of said locking flange being spaced laterally outwards from the vertical margin of the outer frame, and at its other end in an inturned inwardly directed attachment flange arranged to be attached to a respective said vertical margin of each of the outer frames, wherein each said second perimeter frame attachment member is of angle cross-section having one flange contiguous with the inner face of its associated said infill panel, and its other flange projecting outwardly and lying parallel with a respective said vertical margin of the gate arid spaced therefrom so as to form a respective said flange receiving slot which extends approximately the length of the vertical edge of the gate, and detachable securing means for detachably securing each said frame attachment member along a respective vertical margin of its associated said gate.

7. The collapsible storage container of claim 6, wherein said detachable securing means comprises a plurality of locking bolts movable between an extending locking position wherein each locking bolt passes through an aperture formed in said attachment flange of the corner post member and a retracted unlocked position, in which position the corner post member can be detached from its associated said gate.

8. The collapsible storage container of claim 6, wherein said locking means comprises a spring-loaded slidable latching bolt mounted adjacent each of the upper corner regions of the end gates and which is arranged to pass through aligned holes or openings formed in the locking flange of the corner post member and a wall of the frame attachment member.

* * * * *